US007242153B2

(12) United States Patent
Yu et al.

(10) Patent No.: US 7,242,153 B2
(45) Date of Patent: Jul. 10, 2007

(54) PULSE WIDTH MODULATION INVERTER CIRCUIT AND CONTROL METHOD THEREOF

(75) Inventors: Chung-che Yu, Taipei (TW); Chien-Cheng Yang, Taoyuan County (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 275 days.

(21) Appl. No.: 10/907,742

(22) Filed: Apr. 14, 2005

(65) Prior Publication Data

US 2006/0098935 A1 May 11, 2006

(30) Foreign Application Priority Data

Nov. 10, 2004 (TW) ..... 93134221 A

(51) Int. Cl.
*G05F 1/00* (2006.01)

(52) U.S. Cl. ..... 315/291; 315/224; 315/219; 315/307; 315/209 R; 315/244; 315/DIG. 4; 363/41; 363/50; 363/26

(58) Field of Classification Search ..... 315/209 R, 315/291, 244, 224, 219, 276, 307, 308, 360, 315/283, 209 PZ, DIG. 4, DIG. 7; 363/21.02, 363/23, 21.09, 25, 21.11, 26, 35, 40, 41, 50; 323/234–236

See application file for complete search history.

(56) References Cited

U.S. PATENT DOCUMENTS 5,235,254 A * 8/1993 Ho ..... 315/219
5,615,093 A 3/1997 Nalbant ..... 363/25
5,923,129 A 7/1999 Henry ..... 315/307
5,930,121 A 7/1999 Henry ..... 363/16
6,114,814 A 9/2000 Shannon et al. ..... 315/219
6,198,234 B1 3/2001 Henry ..... 315/291
6,259,615 B1 7/2001 Lin ..... 363/98
6,316,881 B1 11/2001 Shannon et al. ..... 315/219
6,396,722 B2 5/2002 Lin ..... 363/98
6,633,138 B2 10/2003 Shannon et al. ..... 315/224
6,804,129 B2 10/2004 Lin ..... 363/98
6,809,938 B2 10/2004 Lin et al. ..... 363/17
2006/0186833 A1* 8/2006 Yu et al. ..... 315/307

* cited by examiner

*Primary Examiner*—Haissa Philogene
(74) *Attorney, Agent, or Firm*—Jianq Chyun IP Office

(57) ABSTRACT

A pulse width modulation inverter circuit is provided. The circuit includes a power switch driver, a power switch, a transformer unit, a feedback detector unit, and a voltage control oscillator. The circuit is electrically coupled to the DC power source to drive a load. The circuit adjusts the pulse width of the signal outputted from the power switch driver according to the voltage inputted to the DC power source. Accordingly, the circuit can maintain a fixed input voltage received by the fluorescent tube. Thus, the high input voltage but low output phenomenon can be avoided.

10 Claims, 7 Drawing Sheets

PULSE WIDTH MODULATION INVERTER CIRCUIT AND CONTROL METHOD THEREOF

CROSS-REFERENCE TO RELATED APPLICATION

This application claims the priority benefit of Taiwan application serial no. 93134221, filed on Nov. 10, 2004. All disclosure of the Taiwan application is incorporated herein by reference.

BACKGROUND OF THE INVENTION

1. Field of the Invention

The present invention relates to a pulse frequency modulation circuit, and more particularly to a pulse width modulation inverter circuit and a method thereof to modulate a pulse width according to a voltage of input direct current power source.

2. Description of the Related Art

Cold cathode fluorescent tubes are a lower-press mercury vapor discharge tube. When voltages are applied to two terminals of a cold cathode fluorescent tube, mercury vapor charges and gas atoms would run into each other to generate ultra-violent (UV) light. The UV light excites fluorescent material on the wall of the tube to emit visible light. Since a filament is not used, the burn-down or break-down of the filament can be avoided. Therefore, the cold cathode fluorescent tube has substantial life span.

In a stable operation, the cold cathode fluorescent tube requires a power frequency from about 30 KHz to 80 KHz and the power has a sinusoidal wave without direct current component. The operational voltage of the tube is almost a constant. The brightness of the tube is determined by the tube current flowing through. The voltage to turn on the tube is 2 to 2.5 times of the stable operational voltage. The turn-on voltage and the operational voltage of the cold cathode fluorescent tube depend on the size of the tube. For 14-inch or 15-inch LCDs, the turn-on voltage of the cold cathode fluorescent tube is about 1400 Vrms. When the maximum rated current of the tube is about 7 mA, the operational voltage is about 650 Vrms.

Generally, a typical cold cathode fluorescent tube uses the inverter in the pulse frequency modulation circuit to invert the DC-input voltage to the AC-output voltage to drive the cold cathode fluorescent tube. In order to stabilize the operational current of the cold cathode fluorescent tube, a resonance tank is used in the pulse frequency modulation circuit to properly adjust the output current of the pulse frequency modulation circuit.

FIG. 1 is configuration showing a relationship between operational frequencies and corresponding output voltages in a resonance tank. Referring to FIG. 1, with different operational frequencies, the output voltages of the resonance tank are different. When the input frequency is equal to the resonant frequency of the resonance tank, the output voltage of the resonance tank reaches the maximum value Vmax. For example, when the operational frequency of the cold cathode fluorescent tube is F1, the output voltage is V02. When the operational frequency of the resonance tank is reduced and close to the resonant frequency F2, the output voltage is increased to V01. By using the relationship between the output voltages and input frequencies, the pulse frequency modulation circuit modifies the operational current of the cold cathode fluorescent tube by changing the operational frequency.

FIG. 2 is a circuit block diagram showing a conventional pulse frequency modulation inverter circuit. Referring to FIG. 2, the power switch 203 is coupled to the DC power source 201 and to the resonance tank 205. The input voltage is then applied to the transformer 207 to drive the cold cathode fluorescent tube 209 to illuminate.

Referring to FIGS. 1 and 2, when the operational frequency of the resonance tank 205 is F1, the operational current to drive the cold cathode fluorescent tube 209 is small. Then, the fluorescent tube current detector 211 outputs a detecting signal to the negative feedback controller 213. The negative feedback controller 213 outputs a feedback voltage signal to reduce the frequency of the voltage control oscillator 215 so that the oscillation signal frequency outputted from the voltage control oscillator 215 is reduced.

The fixed pulse width power switch driver 217 outputs the fixed pulse width signal, which varies with the oscillation frequency outputted from the voltage control oscillator 215. When the oscillation signal frequency is reduced, the frequency of the fixed pulse signal is also reduced. The operational frequency inputted to the resonance tank 205 is near the resonant frequency of the resonance tank 205 to achieve the purpose of increasing the output voltage of the resonant voltage. In contrary, if the current of the cold cathode fluorescent tube 209 at the operation of frequency F1 becomes larger, the system adjusts the operational frequency inputted to the resonance tank 205 and makes the operational frequency shift away from the resonant frequency of the resonance tank 205 and higher than the operational frequency F1. Accordingly, the large current can be reduced.

The change of the operational frequency of the resonance tank 205 may effectively adjust the operational current of the cold cathode fluorescent tube. However, from FIG. 1, the output voltage of the system operating near the range of the resonant frequency of the resonance tank 205, are increased, and so is the efficiency. But, the output voltage and the efficiency of the system operating far from the range of the resonant frequency of the resonance tank 205 are decreased. Accordingly, in the system with DC power sources with a larger voltage range, when the pulse frequency modulation operates under a high input voltage, the frequency needs to be far away from the resonant frequency to stabilize the current outputted to the cold cathode fluorescent tube. In this method, high input voltage is applied to the circuit, but the output efficiency of the circuit is low, which is not cost effective.

SUMMARY OF THE INVENTION

Accordingly, the present invention is directed to a pulse width modulation inverter circuit. According to the voltage input to the direct current (DC) source power, the circuit adjusts the pulse width of the pulse signal outputted from the power switch driver of the circuit to avoid high input voltage but low output efficiency in the circuit.

The present invention is also directed to a control method of a pulse width modulation inverter circuit. According to the voltage input to the DC power source, the pulse width of the pulse width modulation signal is adjusted to avoid high input voltage but low output efficiency.

The present invention provides an inverter circuit, comprising a DC power source, a power switch driver, a power switch, a transformer unit, a load, a detecting unit, an oscillator, a system trigger apparatus, and a protection apparatus. Wherein, the power switch driver outputs a pulse width modulation signal according to a voltage of the DC power source. The power switch comprises a first terminal, a second terminal, and a third terminal. The first terminal of the power switch is electrically coupled to the DC power source, the second terminal of the power switch receives the pulse width modulation signal, and the third terminal of the power switch determines whether to output a signal through the DC power source according to the pulse width modulation signal.

The transformer unit comprises an input terminal and an output terminal. The input terminal of the transformer unit receives the DC power source transferred signal through the power switch, and the output terminal of the transformer unit outputs an AC (alternating current) signal according to the DC power source transferred signal through the power switch. The load comprises an input terminal and an output terminal. The input terminal of the load receives the AC signal, and enables the AC signal flow from the input terminal of the load to the output terminal of the load.

When detecting the operation of the load, the detecting unit outputs a feedback control signal to modulate the AC signal flowing through the load, and a load turn-on signal which indicates a turn-on status of the load. The oscillator receives the feedback control signal, and outputs an oscillation signal according to the feedback control signal. The feedback control signal determines a frequency of the oscillation signal, and the oscillation signal is transmitted to the power switch driver to determine a frequency of the pulse width modulation signal outputted from the power switch driver.

The system trigger apparatus sets the feedback control signal as a predetermined value every time the system trigger apparatus of the inverter circuit is turned on so that the oscillator outputs an oscillation signal with a predetermined frequency. The protection apparatus determines whether to turn off the pulse width modulation signal according to the load turn-on signal such that the turn-on status of the power switch can be changed.

According to the inverter circuit in an embodiment of the present invention, when the feedback control signal outputted from the detecting unit becomes smaller, the operational frequency of the oscillation signal outputted from the oscillator is also reduced. When the feedback control signal outputted from the detecting unit becomes larger, the operational frequency of the oscillation signal outputted from the oscillator is increased.

According to the inverter circuit in an embodiment of the present invention, when the voltage of the DC power source becomes larger, the pulse width of the pulse width modulation signal is reduced, and when the voltage of the DC power source becomes smaller, the pulse width of the pulse width modulation signal is increased.

According to the inverter circuit in an embodiment of the present invention, the detecting unit further comprises a load operation detector and a negative feedback controller. Wherein, the load operation detector detects an operation situation of the load, and outputs the load turn-on signal, and a feedback voltage signal indicating a current flowing through the load. Wherein, the negative feedback controller receives the feedback voltage indicating the current flowing through the load, and outputs the feedback control signal.

According to the inverter circuit in an embodiment of the present invention, the inverter circuit further comprises a dimming apparatus and a dimming function trigger apparatus. The dimming function trigger apparatus receives the load turn-on signal, and outputs a dimming control signal to the power switch driver and the negative feedback controller according to the load turn-on signal. In addition, in this embodiment, when the dimming function is not triggered, the inverter circuit outputs a predetermined maximum output power.

According to the inverter circuit in an embodiment of the present invention, the transformer unit comprises a resonance tank and a transformer. Wherein, the resonance tank receives the DC power source transferred signal through the power switch, and outputs a resonance tank filtered signal according to the DC power source transferred signal through the power switch. The transformer comprises an input terminal and an output terminal. The input terminal of the transformer receives the output signal from the resonance tank, and the output terminal of the transformer outputs the AC signal according to the resonance tank outputted signal.

According to the inverter circuit in an embodiment of the present invention, the power switch is a metal-oxide-semiconductor field effect transistor (MOSFET). The transformer unit is a ceramic piezoelectricity transformer. The power switch driver is a pulse width modulation power switch driver. The oscillator is a voltage control oscillator.

In addition, the present invention provides a control method of a pulse width modulation inverter circuit. In this method, the pulse width modulation inverter circuit is electrically coupled to a direct current (DC) power source to drive a load. The control method comprises: outputting a pulse width modulation signal according to a voltage of the DC power source; determining a signal to couple the required power from the DC power source according to the pulse width modulation signal; outputting an AC signal according to the DC power source coupled signal; driving the load with the AC signal, and outputting an operation efficiency signal according to the AC signal through the load; outputting a feedback control signal according to the operation efficiency signal; and outputting an oscillation signal according to the feedback control signal, wherein the oscillation signal determines an operating frequency of the pulse modulation signal.

According to the control method of the pulse width modulation inverter circuit of an embodiment of the present invention, when the AC signal through the load becomes smaller, the frequency of oscillation signal is reduced, and when the AC signal through the load becomes larger, the frequency of oscillation signal is increased.

According to the control method of the pulse width modulation inverter circuit of an embodiment of the present invention, when the voltage of the DC power source becomes larger, the pulse width of the pulse width modulation signal is reduced, and when the voltage of the DC power source becomes smaller, the pulse width of the pulse width modulation signal is increased.

Accordingly, the pulse width modulation inverter circuit of the present invention adjusts the pulse width of the pulse width signal outputted from the pulse width modulation power switch driving circuit according to the voltage of the DC power source. When the voltage of the DC power source is larger, the pulse width of the pulse signal is adjusted to reduce the input power of the load. The oscillation frequency of the resonance tank seriously shifting away from the resonant frequency can be avoided and the decline of the efficiency of the circuit can also be eliminated.

The above and other features of the present invention will be better understood from the following detailed description of the preferred embodiments of the invention that is provided in communication with the accompanying drawings.

DESCRIPTION OF SOME EMBODIMENTS

Figure 1:
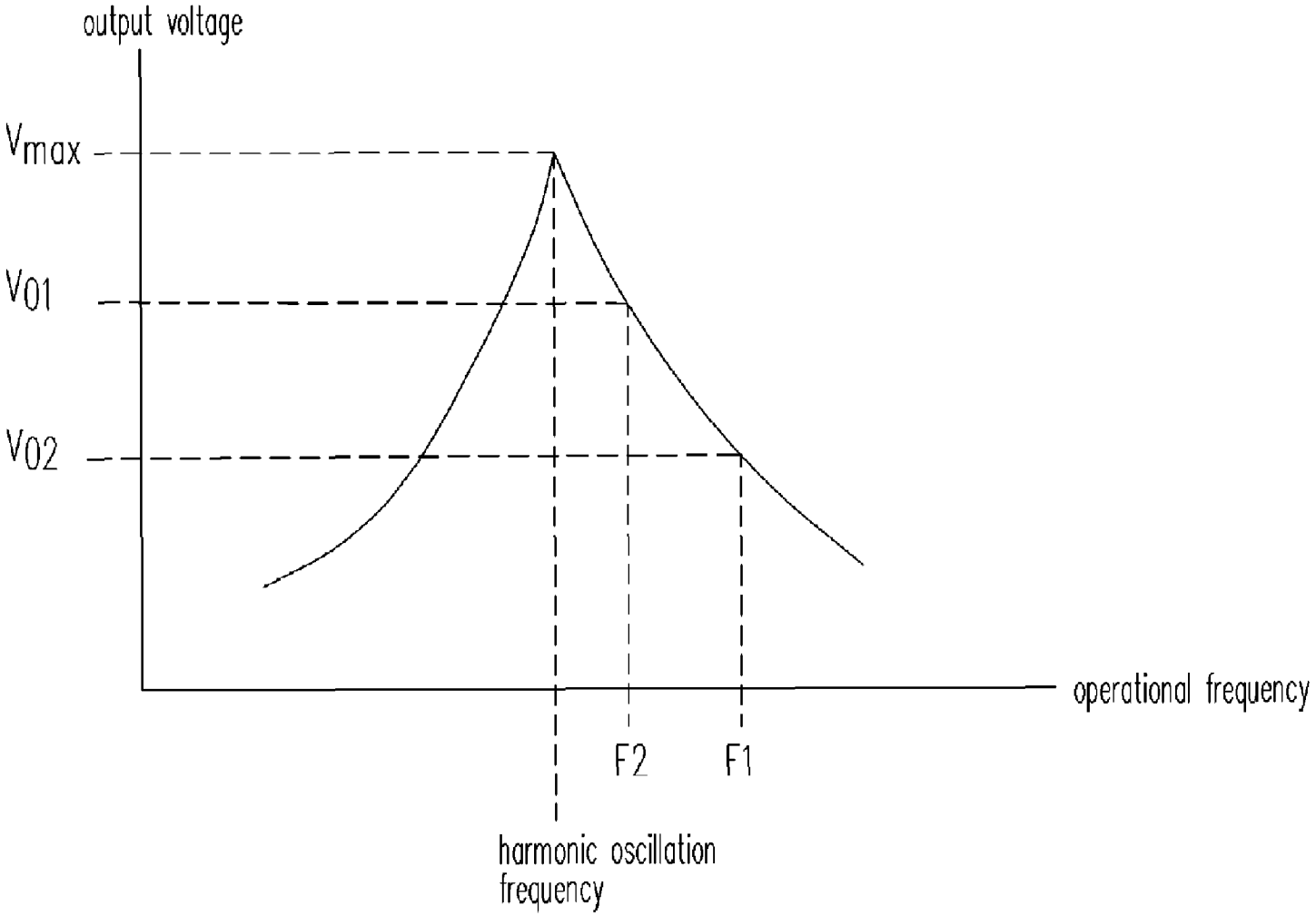
FIG. 1 (PRIOR ART)
FIG. 1 is configuration showing a relationship between operational frequencies and corresponding output voltages of a resonance tank.
Figure 2:
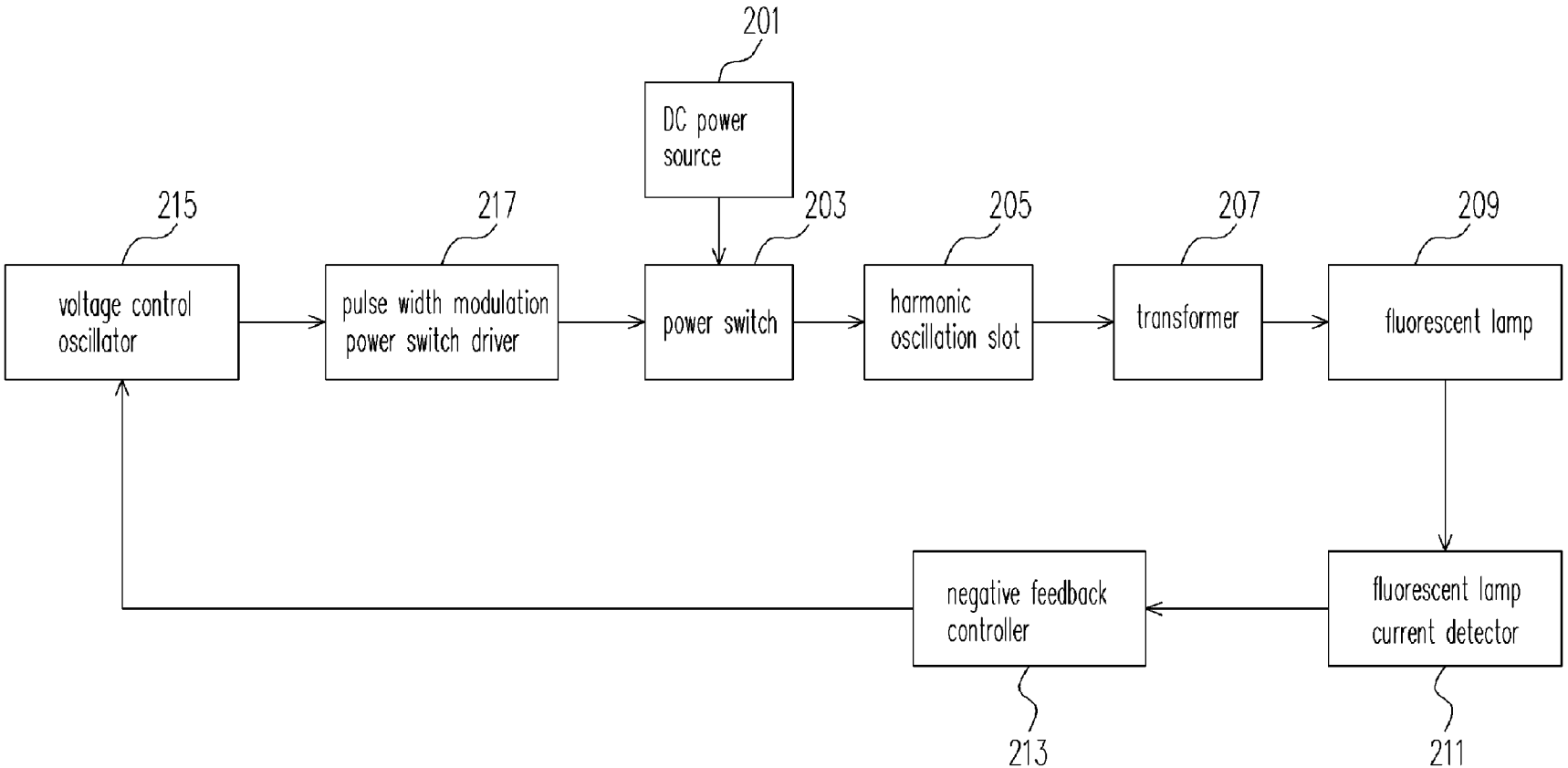
FIG. 2 (PRIOR ART)
FIG. 2 is a circuit block diagram showing a conventional pulse frequency modulation inverter circuit.
Figure 3:
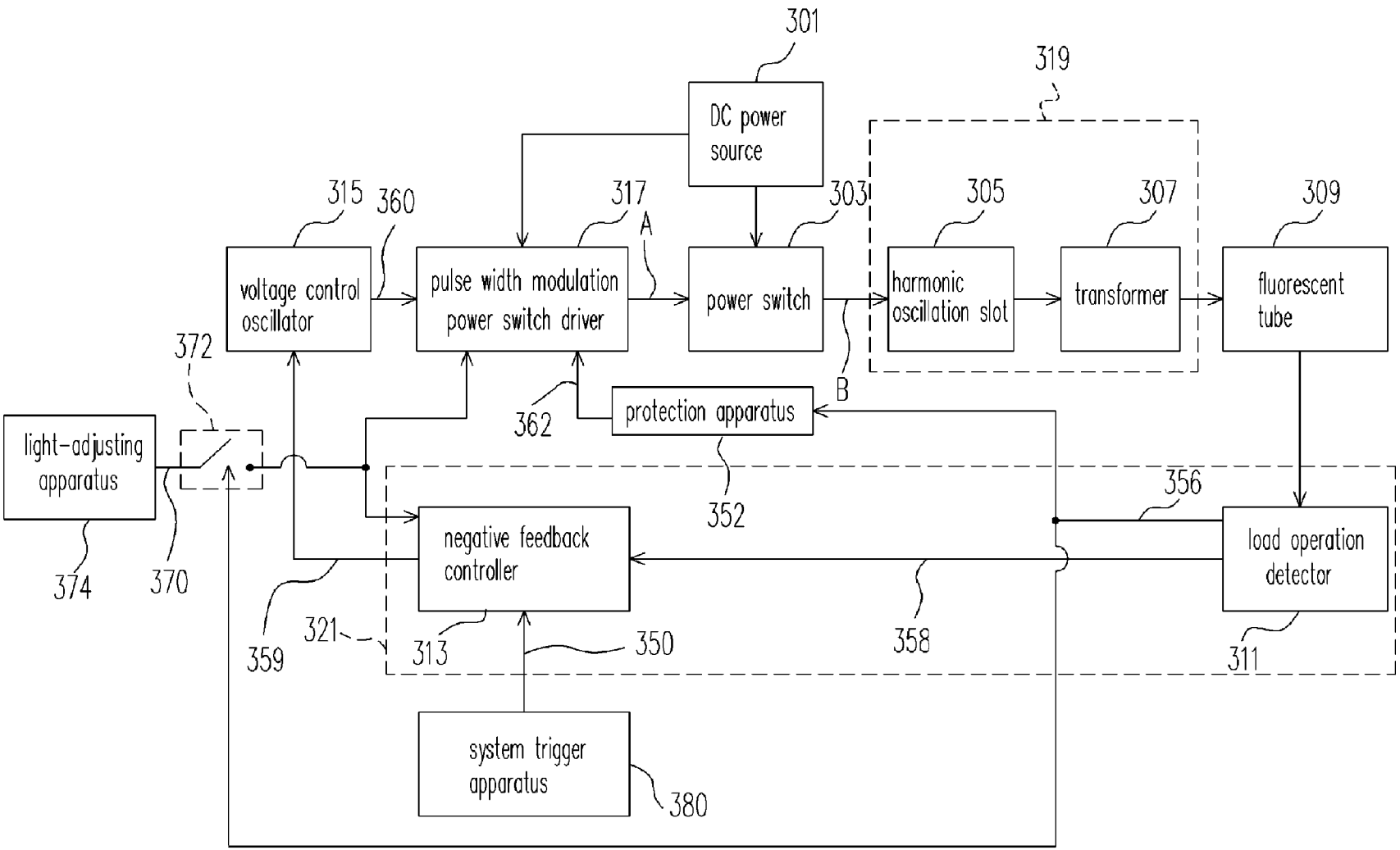
FIG. 3 is a circuit block diagram showing an inverter circuit according to an embodiment of the present invention.

FIG. 3 is a circuit block diagram showing an inverter circuit according to an embodiment of the present invention. Referring to FIG. 3, different from the traditional inverter circuit, the embodiment of the present invention replaces the fixed pulse width power switch driver of the traditional circuit with the pulse width modulation power switch driver 317. The pulse width modulation power switch driver 317 receives the voltage from the DC power source 301 to determine the output pulse width.

When the circuit starts operation, after receiving the voltage of the DC power source 301, the pulse width modulation power switch driver 317 outputs the pulse width modulation signal according to the voltage of the DC power source 301. The power switch 303 determines its own turn-on time period according to the pulse width of the pulse width modulation signal. The power switch 303 also outputs a signal from the DC power source 301 to transmit the voltage of the DC power source 301 to the transformer unit 319 while the power switch 317 is turned on.

In this embodiment, the transformer unit 319 further comprises a resonance tank 305 and a transformer 307. Like the traditional circuit, the resonance tank 305 determines the output power of the resonance tank according to the operational frequency of the resonance tank received. The load 309 of this embodiment needs to be driven by an alternating current (AC) without DC current component. As a result, after receiving the resonance tank output signal transmitted from the resonance tank 305, the transformer 307 transforms the DC-type resonance tank output signal to the AC-type signal to enforce the operation of the load 309. In this embodiment, the load 309 of the inverter circuit is a cold cathode fluorescent tube.

In this embodiment, the detecting unit 321 comprises the load operation detector 311 and the negative feedback controller 313. Wherein, the load operating detector 311 detects the operation status of the cold cathode fluorescent tube 309, and outputs a feedback voltage signal 358 to the negative feedback controller 313, wherein the feedback voltage signal 358 indicates a current flowing through the cold cathode fluorescent tube 309. The negative feedback controller 313 determines the value of the feedback control signal 359 outputted from its output terminal according to the feedback voltage signal 358. Finally, the oscillator 315 determines the frequency of the oscillation signal 360 according to the value of the feedback control signal 359. In this embodiment, the oscillator 315 is a voltage control oscillator.

In this embodiment, when the voltage of the DC power source 301 becomes smaller, the operational current of the cold cathode fluorescent tube 309 declines. The load operation detector 311 then outputs the feedback voltage signal 358 indicating a current flowing through the cold cathode fluorescent tube 309 to the negative feedback controller 313. After receiving the signal, the negative feedback controller 313 reduces the value of the feedback control signal 359 to be outputted from the output terminal. When the feedback control signal 359 received by the voltage control oscillator 315 is reduced, the frequency of the oscillation signal 360 is also reduced.

The operational frequency of the pulse width modulation signal outputted from the pulse width modulation power switch driver 317 that varies with the oscillation signal 360 outputted from the voltage control oscillator 315. As described above, when the frequency of the oscillation signal 360 is reduced, the operational frequency of the pulse width modulation signal is also reduced. The oscillation frequency of the pulse width modulation signal received by the resonance tank 305 would be closer to the resonant frequency of the resonance tank 305. The output power of the resonance tank 305 would be increased to enhance the operational current of the cold cathode fluorescent tube 309.

According to the method described above, when the voltage of the DC power source 301 becomes larger, the operational frequency of the pulse width modulation is also increased, and shifts away from the resonant frequency of the resonance tank 305. The output power of the resonance tank 305 is reduced. Accordingly, the high input voltage but low output efficiency phenomenon would occur.

The pulse width modulation power switch driver 317 adjusts the pulse width of the pulse width modulation signal according to the voltage of the DC power source 301. When the voltage of the DC power source 301 becomes larger, the pulse width of the pulse width modulation signal is smaller to reduce the power inputted to the resonance tank 305. When the load operation detector 311 detects the current flowing through the cold cathode fluorescent tube 309, the operational frequency is not increased with the rise of the voltage of the DC power source 301. Accordingly, the frequency of the oscillation signal 360 outputted from the resonance tank 305 can be maintained near the resonant frequency of the resonance tank 305.

In addition, this embodiment also includes a system trigger apparatus 380. The system trigger apparatus 380 outputs the system initial input signal 350 to the negative feedback controller 313 to enforce the negative feedback controller 313 outputs a predetermined feedback control signal 359 every time the negative feedback controller 313 of the inverter circuit is turned on. Accordingly, the output of the voltage control oscillator 315 is the predetermined oscillation signal 360, which is far away and higher than the resonant frequency of the resonance tank 305. The advantage of this embodiment is that power of the cold cathode fluorescent tube 309 is gradually increased from a small power when triggered.

This embodiment further includes a protection apparatus 352. The load operation detecting unit 311 detects the operation status of the cold cathode fluorescent tube 309, and outputs the load turn-on signal 356 indicating whether the cold cathode fluorescent tube 309 is turned on to the protection apparatus 352. According to the load turn-on signal 356, the protection apparatus 352 determines whether to output a protection control signal 362 to change the output of the pulse width modulation power switch driver 317 and turn off the power switch 303.

In practice, the protection apparatus 352 operates with a timer. Usually, a predetermined ignition period is provided to turn on the cold cathode fluorescent tube 309. When the cold cathode fluorescent tube 309 is turning on, the protection apparatus 352 does not operate. Once the predetermined time period is over, the protection apparatus 352 stars operation.

In addition, this embodiment further includes a dimming apparatus 374 and a dimming function trigger switch 372. The dimming apparatus 374 outputs a dimming signal 370 to the dimming function trigger switch 372. The dimming signal 370 is outputted to the negative feedback controller 313 and the pulse width modulation power switch driver 317 through the dimming function trigger switch 372. The brightness of the cold cathode fluorescent tube 309 is dimmed by simultaneously changing the pulse width modulation signal and the feedback control signal 359. Wherein, the dimming function trigger switch 372 determines whether to output the dimming signal 370 according to whether the load turn-on signal 356 is received.

In this embodiment, in order to ensure that the cold cathode fluorescent tube 309 is turned on by sufficient power, the dimming signal 370 is transmitted to the apparatus describe in this embodiment after the load turn-on signal 356 indicates the fluorescent tube is turned on. The dimming signal 370 can be a stable DC voltage signal or a low-frequency pulse where the cold cathode fluorescent tube 309 is dimmed by low-speed switch of light and shade (or dark). To avoid the flashing effect, the frequency is usually higher than 200 Hz. In LCD, the dimming signal 370 can be generated with the clock of the display to reduce interference. In order to make sure that the cold cathode fluorescent tube 309 is turned on, the dimming function is not performed before the cold cathode fluorescent tube 309 is turned on. In addition, a sufficient voltage output required by the cold cathode fluorescent tube 309 is designed to turn on the cold cathode fluorescent tube 309.

Figure 4:
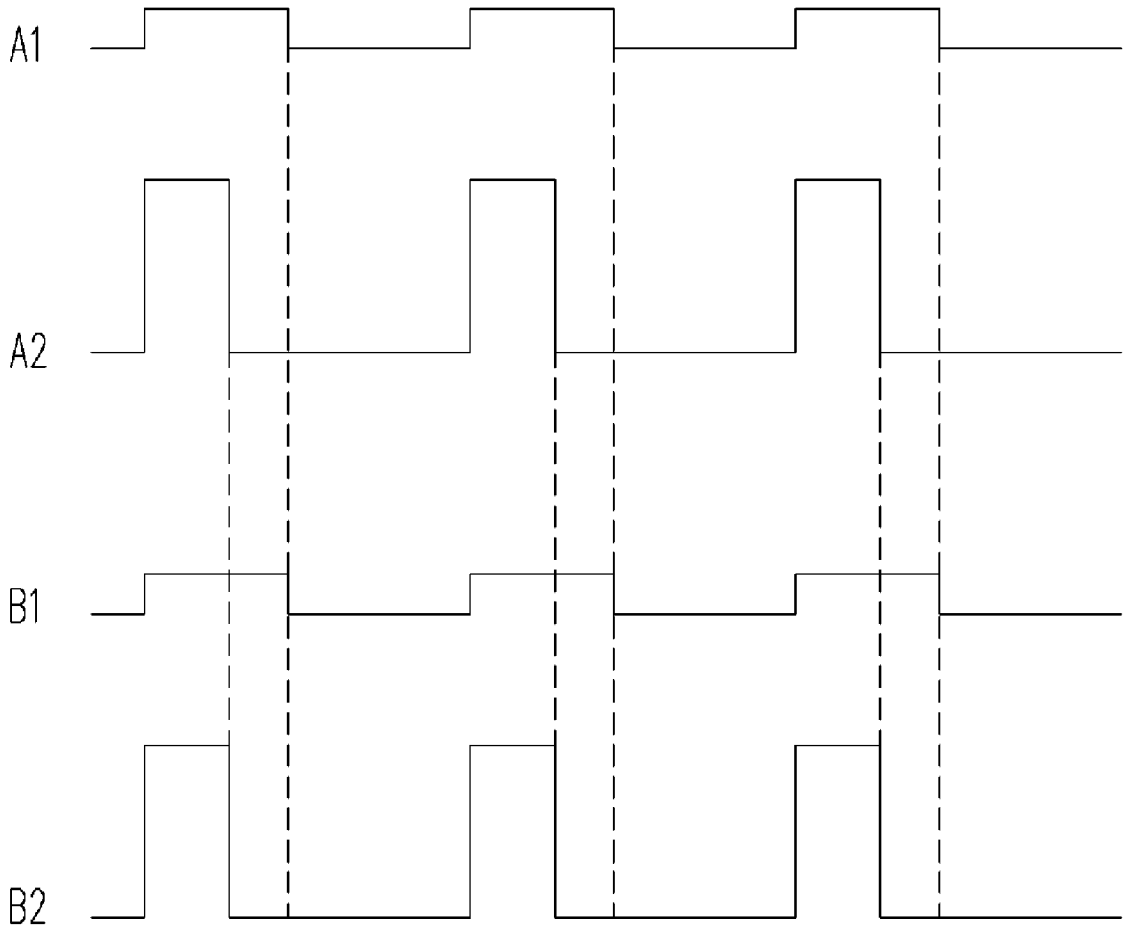
FIG. 4 is a configuration showing pulse widths of voltages at the input terminal and output terminal of the power switch 303.

FIG. 4 is a configuration showing pulse widths of voltages at the input terminal and output terminal of the power switch 303. Referring to FIGS. 3 and 4, when the DC power source 301 outputs a lower voltage, and the lower voltage is processed by the pulse width modulation power switch driver 317. The input terminal A of the power switch 303 receives the pulse width modulation signal A1 as the input signal, and the pulse width of the signal B1 outputted from the output terminal B to transfer power from the DC power source with the lower voltage is as same as that of the pulse width modulation signal A1 received at the input terminal A1.

In contrary, when the DC power source 301 outputs a higher voltage, and the higher voltage is processed by the pulse width modulation power switch driver 317. The input terminal A of the power switch 303 receives the pulse width modulation signal A2 as the input signal. Due to the higher voltage outputted from the DC power source 301, the pulse width of the pulse width modulation signal A2 is smaller than that of the pulse width modulation signal A1. The signal to transfer the power from the DC source to the resonance tank from the output terminal B of the power switch 303 has a higher voltage, but a narrower pulse width.

The signals which transfer the power from the DC source are received by the resonance tank 305 have different voltages and pulse widths. They have the same operational frequency and average power. Accordingly, whether the voltage of the DC power source is high or low, the power switch 303, which controls the pulse width modulation inverter circuit operates within the range near the resonant frequency of the resonance tank 305. The circuit thus operates with a high efficiency. The high input voltage but low output efficiency issue in the prior art can be avoided.

Figure 5:
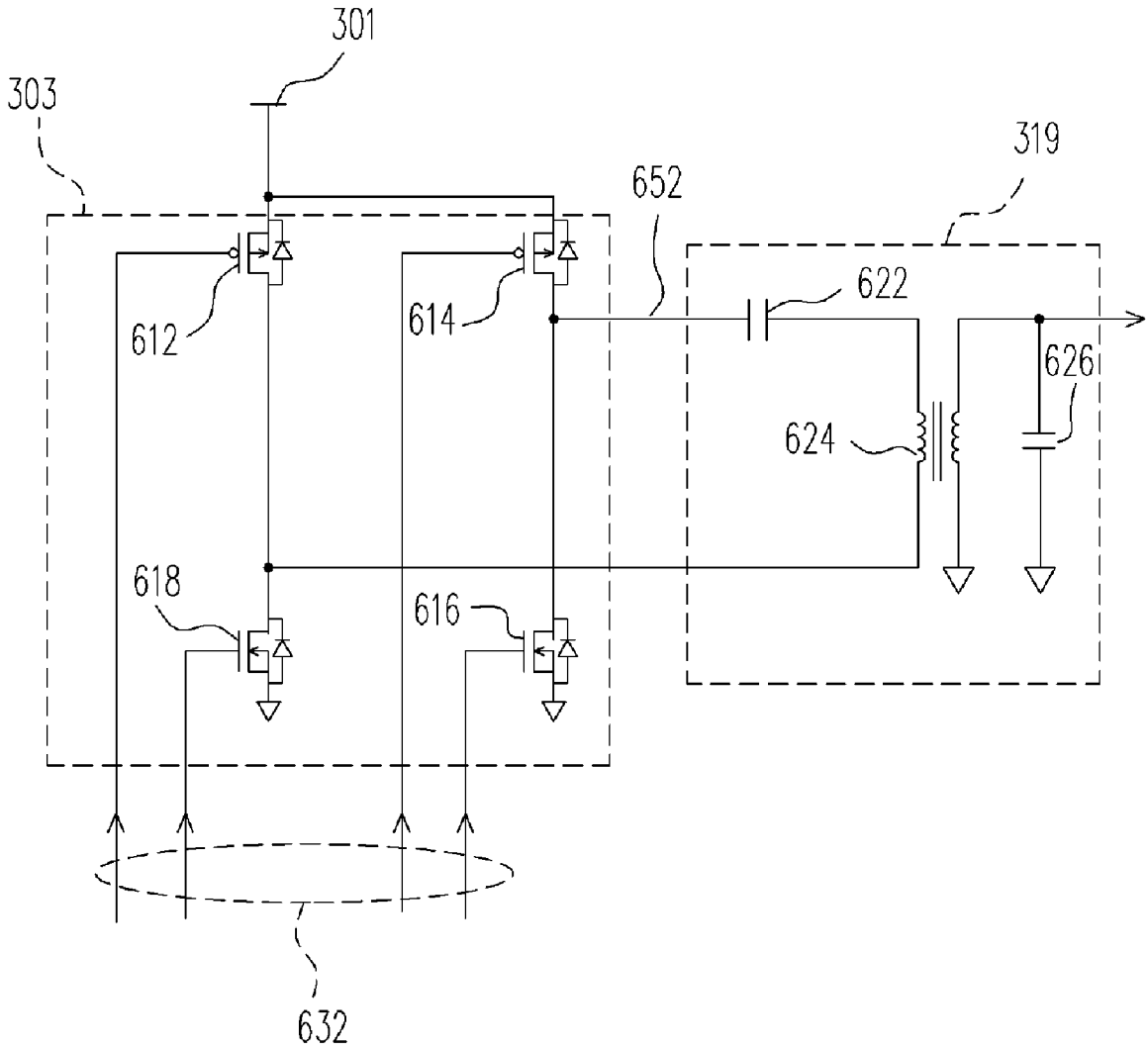
FIG. 5 is a configuration showing an internal circuit of the inverter circuit according to an embodiment of the present invention.

FIG. 5 is a configuration showing an internal circuit of the inverter circuit according to an embodiment of the present invention. Referring to FIG. 5, the DC power source 301 is coupled to the power switch 303. The power switch 303 comprises two P-type metal-oxide-semiconductor field effect transistors (MOSFETs) 612 and 614, and two N-type MOSFETs 616 and 618. The power switch 303 controls the signal 652 used to transfer the power from the DC power source through the pulse width modulation signal 632. The signal 652 is transmitted to the transformer unit 319. The transformer unit 319 comprises a winding transformer 624, and resonance capacitors 622 and 626.

Figure 6:
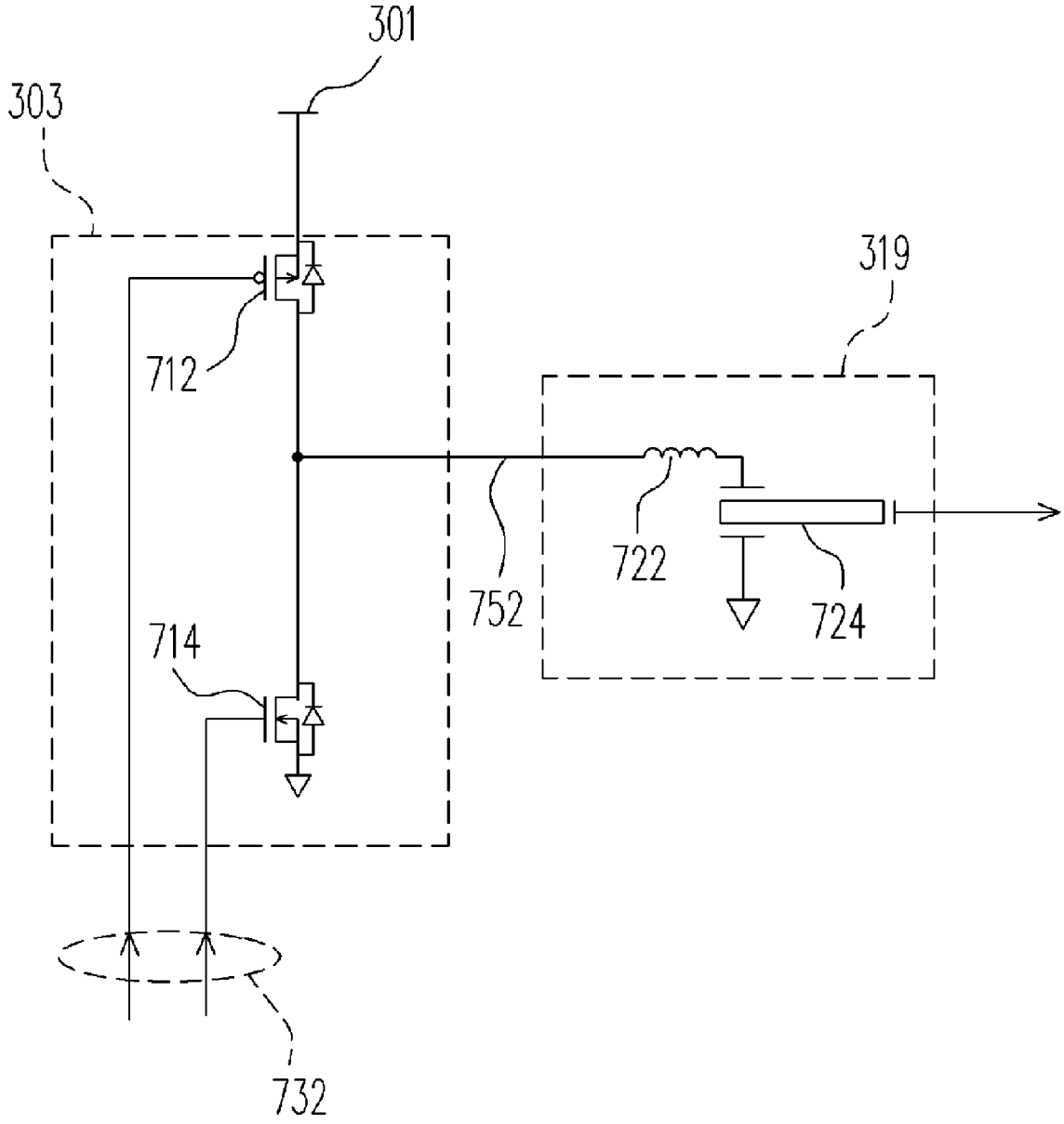
FIG. 6 is a configuration showing another internal circuit of an inverter circuit according to an embodiment of the present invention.

FIG. 6 is a configuration showing another internal circuit of an inverter circuit according to an embodiment of the present invention. Referring to FIG. 6, the DC power source 301 is coupled to the power switch 303. The power switch 303 comprises a P-type MOSFET 712, and an N-type MOSFET 714. The power switch 303 controls the signal 752 used to transfer the power from the DC power source through the pulse width modulation signal 732. The signal 752 is transmitted to the transformer unit 319. The transformer unit 319 comprises a ceramic piezoelectricity transformer 724, and a resonance capacitor 722.

Figure 7:
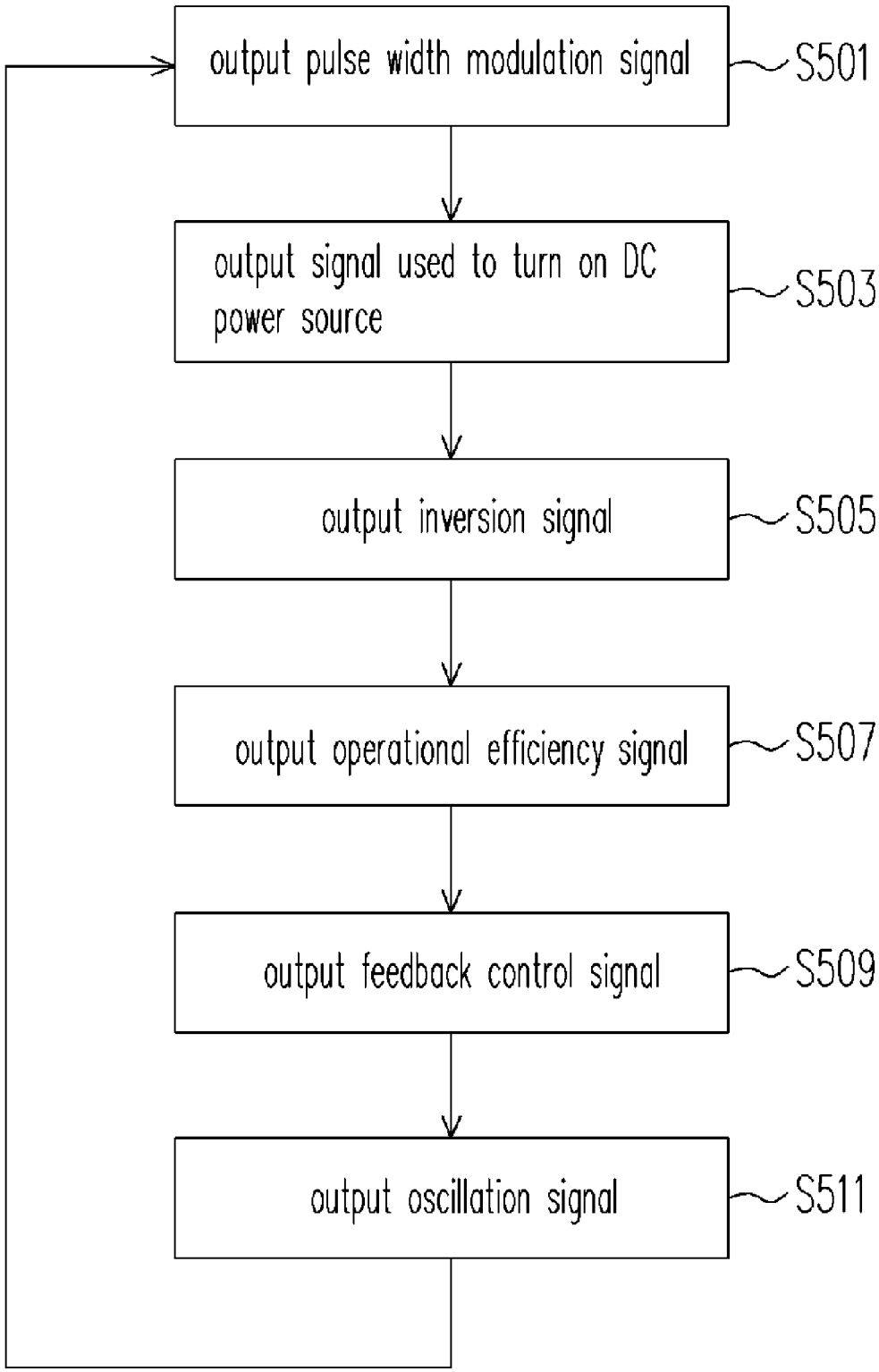
FIG. 7 is a flowchart showing a control method of a pulse width modulation inverter circuit according to an embodiment of the present invention.

FIG. 7 is a flowchart showing a control method of a pulse width modulation inverter circuit according to an embodiment of the present invention. The pulse width modulation inverter circuit is electrically coupled to the DC power source to drive a load. In the step S501, the pulse width modulation inverter circuit outputs a pulse width modulation signal according to the voltage of the DC power source. In this embodiment, the pulse width of the pulse width modulation signal is inversely proportional to the voltage of the DC power source. The higher the voltage, the narrower the pulse width.

In the step S503, the pulse width modulation inverter circuit determines whether to output a signal to transfer the power from DC power source to system according to the pulse modulation signal. In the step S505, the pulse width modulation inverter circuit determines the value of the inversion signal according to the operational frequency of the DC power source. In this embodiment, when the operational frequency of the signal to transfer the power from the DC power source is high, the AC signal outputted to the load therefore becomes smaller. In the step S507, the AC signal drives the load in the pulse width modulation inverter circuit, and outputs an operation efficiency signal according to the current of the operating load.

In the step S509, a feedback voltage signal is outputted according to the operation efficiency signal. In the step S511, the oscillation signal is outputted according to the feedback voltage signal. Wherein, the operational frequency of the pulse width modulation signal in the step S501 changes according to the oscillation frequency of the oscillation signal.

Accordingly, the present invention provides the pulse width modulation inverter circuit. As the traditional circuit, the circuit of the present invention can maintain the load operation under a stable current according to the operational current of the load incorporating with the resonance tank to adjust the operational frequency of the oscillation signal.

The circuit of the present invention also automatically adjusts the pulse width of the pulse signal when the voltage of the DC power source becomes larger. Accordingly, the average power of the input power of the signals receive by the resonance tank is maintained at a constant value. The signal of the resonance tank thus operates in the smaller range near the resonant frequency. The high input voltage but low output efficiency phenomenon can thus be avoided.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. An inverter circuit, comprising:

a direct current (DC) power source;

a power switch driver, the power switch driver outputting a pulse width modulation signal according to a voltage of the DC power source;

a power switch, comprising a first terminal, a second terminal, and a third terminal, the first terminal of the power switch electrically coupled to the DC power source, the second terminal of the power switch receiving the pulse width modulation signal, the third terminal of the power switch determining whether to output a signal used to transfer the power from the DC power source according to the pulse width modulation signal;

a transformer unit, comprising an input terminal and an output terminal, the input terminal of the transformer receiving the signal used to transfer the power from the DC power source, the output terminal of the transformer outputting an alternating current(AC) signal;

a load, comprising an input terminal and an output terminal, the input terminal of the load receiving the AC signal, and letting the AC signal flow from the input terminal of the load to the output terminal of the load;

a detecting unit, the detecting unit outputting a feedback control signal to regulate the AC signal flowing through the load, and a load turn-on signal which indicates a turn-on situation of the load;

an oscillator, receiving the feedback control signal, and outputting an oscillation signal according to the feedback control signal, the feedback control signal determining a frequency of the oscillation signal, the oscillation signal being transmitted to the power switch driver to determine a frequency of the pulse width modulation signal outputted from the power switch driver;

a system trigger apparatus, setting the feedback control signal as a predetermined value every time the system trigger apparatus of the inverter circuit is turned on so that the oscillator outputs an oscillation signal with a predetermined frequency; and a protection apparatus, determining whether to change the pulse width modulation signal according to the load turn-on signal.

2. The inverter circuit of claim 1, wherein when the voltage of the DC power source becomes larger, a pulse width of the pulse width modulation signal is reduced, and when the voltage of the DC power source becomes smaller, the pulse width of the pulse width modulation signal is increased.

3. The inverter circuit of claim 1, wherein the detecting unit further comprises:

a load operation detector, the load operation detector detecting an operation status of the load, and outputting the load turn-on signal, and a feedback voltage signal indicating a current flowing through the load; and a negative feedback controller, receiving the feedback voltage indicating the current flowing through the load, and outputting the feedback control signal.

4. The inverter circuit of claim 1, wherein the load is a fluorescent tube.

5. An inverter for a dimmable fluorescent tube, the inverter comprising:

a direct current (DC) power source;

a power switch driver, the power switch driver outputting a pulse width modulation signal with different pulse width according to different voltage of the DC power source;

a power switch, comprising a first terminal, a second terminal, and a third terminal, the first terminal of the power switch electrically coupled to the DC power source, the second terminal of the power switch receiving the pulse width modulation signal, the third terminal of the power switch transfer the power from the DC power source according to the pulse width modulation signal;

a transformer unit, comprising an input terminal and an output terminal, the input terminal of the transformer receiving the signal used to transfer the power from the DC power source, the output terminal of the transformer outputting an AC signal;

a fluorescent tube, comprising an input terminal and an output terminal, the input terminal of the fluorescent tube receiving the AC signal, and letting the AC signal flow from the input terminal of the fluorescent tube to the output terminal of the fluorescent tube;

a detecting unit, detecting an operation status of the fluorescent tube, outputting a feedback control signal to regulate the AC signal flowing through the fluorescent tube, and a fluorescent tube turn-on signal which indicates a turn-on status of the fluorescent tube;

an oscillator, receiving the feedback control signal, and outputting an oscillation signal according to the feedback control signal, the feedback control signal determining a frequency of the oscillation signal, the oscillation signal being transmitted to the power switch driver to determine a operational frequency of the pulse width modulation signal outputted from the power switch driver;

a system trigger apparatus, setting the feedback control signal as a predetermined value every time the system trigger apparatus of the inverter circuit for the dimmable fluorescent tube is turned on so that the oscillator outputs an oscillation signal with a predetermined frequency;

a protection circuit, determining whether to change the pulse width modulation signal according to the fluorescent tube turn-on signal; and a dimming function trigger apparatus, receiving the fluorescent tube turn-on signal, and outputting a dimming control signal to the power switch driver and the negative feedback controller according to the fluorescent tube turn-on signal.

6. The inverter for the light-adjustable fluorescent tube of claim 5, wherein when the dimming function trigger apparatus is not turned on, the inverter for the dimmable fluorescent tube generates a preset maximum output.

7. The inverter for the dimmable fluorescent tube of claim 5, wherein the dimming control signal is a pulse signal generated according to a driving clock of a display.

8. A control method of a pulse width modulation inverter circuit, the pulse width modulation inverter circuit being electrically coupled to a direct current (DC) power source to drive a load, the control method comprising:

outputting a pulse width modulation signal according to a voltage of the DC power source;

determining whether to output a signal which transfer the power from the DC power source according to the pulse width modulation signal;

outputting an AC signal according to the signal used to transfer the power from the DC power source;

driving the load with the AC signal, and outputting a operation efficiency signal according to an operation status of the load;

outputting a feedback control signal according to the operation efficiency signal; and outputting an oscillation signal according to the feedback control signal, wherein the oscillation signal determines an oscillation frequency of the pulse modulation signal.

9. The control method of a pulse width modulation inverter circuit of claim 8, wherein when the operating efficiency signal changes, the oscillation frequency outputted from the oscillation signal changes accordingly.

10. The control method of a pulse width modulation inverter circuit of claim 8, wherein when the voltage of the DC power source becomes larger, the pulse width of the pulse width modulation signal is reduced, and when the voltage of the DC power source becomes smaller, the pulse width of the pulse width modulation signal is increased.

* * * * *